US005629609A

United States Patent [19]

Nguyen et al.

[11] Patent Number: 5,629,609

[45] Date of Patent: May 13, 1997

[54] METHOD AND APPARATUS FOR IMPROVING THE DROP-OUT VOLTAGE IN A LOW DROP OUT VOLTAGE REGULATOR

[75] Inventors: Baoson Nguyen, Plano; Fernando D. Carvajal, McKinney, both of Tex.

[73] Assignee: Texas Instruments Incorporated, Dallas, Tex.

[21] Appl. No.: 207,863

[22] Filed: Mar. 8, 1994

[51] Int. Cl.[6] ..... G05F 1/56

[52] U.S. Cl. ..... 323/269; 323/270; 323/273

[58] Field of Search ..... 323/269, 270, 323/274, 275, 280

[56] References Cited

U.S. PATENT DOCUMENTS

| | | | |
|---|---|---|---|
| 4,529,927 | 7/1985 | O'Sullivan et al. | 323/322 |
| 4,536,699 | 8/1985 | Baker | 323/276 |
| 4,543,522 | 9/1985 | Moreau | 323/303 |
| 5,180,966 | 1/1993 | Sugawara et al. | 323/308 |

*Primary Examiner*—Peter S. Wong
*Assistant Examiner*—Rajnikant B. Patel
*Attorney, Agent, or Firm*—Alan K. Stewart; Richard L. Donaldson; William B. Kempler

[57] ABSTRACT

A low voltage drop out circuit (10) has a voltage regulating transistor (13) between a supply voltage (12) and an output terminal (28). An active feedback loop controls the voltage regulating transistor (13) according to a magnitude of the supply voltage (12) to control the voltage on the output terminal (28). A reference voltage source (25) produces a reference voltage, and a switch, which may be a second transistor (45) of similar type than the voltage regulating transistor (13), is connected in parallel with the voltage regulating transistor (13). A comparing circuit (42) detects when the supply voltage (12) falls below the reference voltage (25) to operate the second transistor (45), which may be sized to be much larger than the voltage regulating transistor (13) to effectively short across the voltage regulating transistor (13) when the supply voltage (12) falls below a predetermined level.

21 Claims, 1 Drawing Sheet

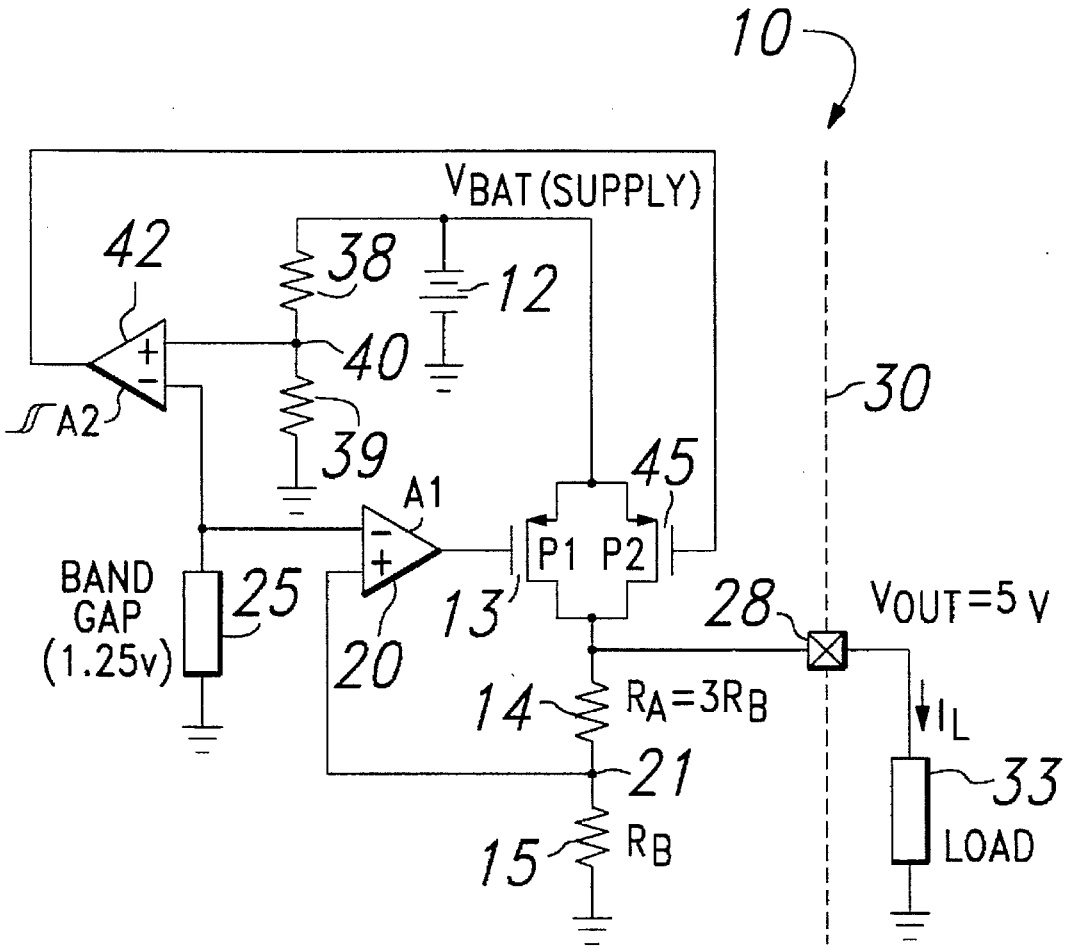
10
VBAT (SUPPLY)
42
38
12
40
30
A2
39
45
A1
P1 P2
BAND
GAP
(1.25v)
25
13
28
VOUT=5 V
20
14
RA=3RB
IL
21
33
15
RB
LOAD

METHOD AND APPARATUS FOR IMPROVING THE DROP-OUT VOLTAGE IN A LOW DROP OUT VOLTAGE REGULATOR

BACKGROUND OF THE INVENTION

1. FIELD OF THE INVENTION

This invention relates to improvements in voltage regulator circuits, and more particularly to improvements in voltage regulator circuits that have a low drop out voltage feature, and still more particularly to improvements in methods and circuits for extending the low voltage operating range of a voltage regulator circuit without interfering with the stability of the main control loop of the low voltage drop out circuit.

2. RELEVANT BACKGROUND

In many applications, it is desirable to monitor the level of a supply voltage, often to enable some specific action to be taken. For example, in many computer or electronics applications, when a supply voltage is detected that is approaching a level below which the circuit cannot properly operate, various power down routines may be initiated, for example to preserve data in a computer system, to write diagnostic data to a nonvolatile memory in an automotive system, or similar application. In the past, however, such low voltage drop out detectors have been unable to respond as rapidly as may be desired in many applications.

In a typical low voltage drop out regulator, an operational amplifier is provided that has a reference voltage applied to one of its inputs. The supply voltage is connected in a current flow path through a voltage regulating transistor, typically an MOS transistor, the gate of which being controlled by the output from the operational amplifier. A resistor is provided in the current flow path through the voltage regulating transistor to develop a voltage for application to the other input of the operational amplifier. When the voltage developed across the resistor falls below the reference voltage, the operational amplifier output changes state to turn on the voltage regulating transistor to apply the entire battery voltage (or as much of it as possible) to the output pin and load connected thereto. However, since the voltage regulating transistor has a voltage drop across it that is not insignificant, the useable voltage delivered to the load often falls faster than desired, resulting in possibly losing data that might otherwise be saved.

In efforts to correct this problem, it has been proposed to increase the size of the voltage regulating transistor. One of the problems with this solution, however, is that the size of the voltage regulating transistor limits the speed by which the supply voltage can be applied to the output pin. In normal operation, the voltage regulating transistor is held on to a degree determined by the voltage developed across the resistor so that as the voltage rises and falls, the transistor is turned on to a corresponding greater or lesser extent to provide an essentially constant voltage at the output. However, if the size of the voltage regulating transistor is increased too much, the loop stability is affected because of the higher capacitance presented by the larger sized transistor capacitance.

SUMMARY OF THE INVENTION

In light of the above it is, therefore, an object of the invention to provide a method and apparatus for improving the drop out voltage of a voltage regulator circuit or the like.

It is another object of the invention to provide a method and circuit for extending the low voltage operating range of a voltage regulator circuit without interfering with the stability of the main control loop of the low voltage drop out circuit or the like.

These and other objects, features and advantages of the invention will be apparent to those skilled in the art from the following detailed description of the invention, when read in conjunction with the accompanying drawings and appended claims.

The solution to the problem of extending the low voltage operating range of a voltage regulator circuit without interfering with the stability of the main control loop of the low voltage drop out circuit is solved by using a comparator for sensing the supply voltage. When the supply voltage goes low, the main loop gain goes low, since the pass device transconductance, gm, becomes smaller as the device goes into saturation (for bipolar devices), or into linear regions (for MOS devices). With heavy load, the output voltage can be out of specification. By detecting the supply crossing a specific threshold, the comparator will turn on a second pass device, boosting the current drive capability, preventing the output from falling out of specification. An advantage of the invention is that in normal supply, the second pass device, which may be provided simply by a switch, is off and does not interfere with the gain and the stability of the control loop. When the supply voltage goes below the threshold of the comparator, the switch is turned on, driving the gate of the output device to the maximum $V_{gs}$.

According to a broad aspect of the invention, a low voltage drop out circuit is provided. The circuit has a voltage regulating transistor between a supply voltage and an output terminal. An active feedback loop controls the voltage regulating transistor according to a magnitude of the supply voltage to control the voltage on the output terminal. A reference voltage source produces a reference voltage, and a switch, which may be a second transistor of similar type than the voltage regulating transistor, is connected in parallel with the voltage regulating transistor. A comparing circuit detects when the supply voltage falls below the reference voltage to operate the switch. The second transistor may be sized to be much larger than the voltage regulating transistor to effectively short across the voltage regulating transistor when the supply voltage falls below a predetermined level. The voltage regulating and second transistors can be MOS transistors.

In one embodiment, the active feedback loop is configured to control the voltage regulating transistor to connect the supply voltage directly to the output terminal when the supply voltage falls below a predetermined value with respect to the reference voltage. The active feedback loop comprises at least one sense resistor across which a sense voltage related to the output voltage is developed. An operational amplifier is provided, which has inputs for receiving the sense voltage and the reference voltage and an output to control the voltage regulating transistor. Preferably this sense resistor comprises a voltage divider comprising first and second sense resistors, with the sense voltage derived between the first and second sense resistors.

The comparing circuit may include at least another sense resistor across which another sense voltage related to the supply voltage is developed, and a comparator that has inputs for receiving this sense voltage and the reference voltage and an output to control the switch. If needed, the comparator may have a predetermined hysteresis.

According to another broad aspect of the invention, a low voltage drop out circuit is presented that has a voltage regulating transistor between a supply voltage and an output terminal. A reference voltage source produces a reference voltage, and an operational amplifier compares the reference voltage to a voltage related to an output voltage on the output terminal. An output of the operational amplifier is connected to control the voltage regulating transistor according to a magnitude of the output voltage to control the voltage on the output terminal. A switch is connected in parallel with the voltage regulating transistor, and a comparator compares the reference voltage to a voltage related to the supply voltage. An output of the comparator is connected to control the switch according to a magnitude of the supply voltage to short across the voltage regulating transistor when the supply voltage falls below a predetermined level established by the reference voltage. The operational amplifier is configured to control the voltage regulating transistor to connect the supply voltage directly to the output terminal when the output voltage falls below a predetermined value with respect to the reference voltage.

In a preferred embodiment, the switch is a second transistor, preferably a MOS transistors of similar construction, but of larger size than the voltage regulating transistor. The voltage related to the supply voltage may be provided by a sense resistor across which a sense voltage related to the supply voltage is developed. The comparator may be provided with a predetermined hysteresis.

BRIEF DESCRIPTION OF THE DRAWINGS

The invention is illustrated in the accompanying drawings, in which:

FIG. 1 is an electrical schematic diagram of a low voltage drop out circuit, in accordance with a preferred embodiment of the invention.

DETAILED DESCRIPTION OF THE PREFERRED EMBODIMENTS

A voltage regulator circuit 10, in accordance with a preferred embodiment of the invention is shown in FIG. 1. As shown, a battery 12 or other source of potential is connected in a current flow path between ground, a P-channel MOS (PMOS) transistor 13, and a voltage divider that includes resistors 14 and 15. Although this circuit is illustrated with PMOS transistors, it is understood that transistors of other conductivities, such as NMOS devices, and device types, such as bipolar transistor types, can be equally advantageously employed with appropriate circuit modifications apparent to those skilled in the art. The value of the voltage supplied by the power source 12 can be selected as needed, and the output adjusted in dependence upon the value of a set of voltage divider resistors 14 and 15 and the output voltage from an operational amplifier 20 that controls the current flowing in the PMOS transistor 13.

It should be noted that although a battery is shown to provide the supply voltage, depending upon the application, the supply voltage may be provided by an electronic power supply, or the like. In such cases failures are often encountered in which the voltage provided by the voltage source falls at a timed rate, in comparison to a step function as when the supply may be directly disconnected. For example, in many power supplies in use, filter capacitors are used that provide such decay characteristic when the power supply is interrupted. In electronics applications, such as in computer applications, or the like, the decay time can be used if it is long enough to store or preserve data until the power is restored.

The operational amplifier 20 is connected to the node 21 between the resistors 14 and 15 of the voltage divider at its non-inverting input terminal. The output from the operational amplifier 20 is connected to the gate of the PMOS transistor 13. A bandgap voltage generator 25, or other source of reference potential, is connected between the inverting input terminal of the operational amplifier 20 and ground, and provides a reference voltage on the operational amplifier 20, for example, of 1.25 volts.

The output from the circuit 10 is derived on the drain of the PMOS transistor 13, and is delivered, for example, to a pin 28 on an integrated circuit 30 on which the circuit 10 is constructed. The output voltage provided by the circuit 10 may be, for example, 5 volts, as regulated through the operation of the feedback loop that includes the operational amplifier 20, PMOS transistor 13, and resistors 14 and 15.

In the operation of the circuit above described, the operational amplifier 20, through the operation of the feedback loop including the PMOS transistor 13 and resistors 14 and 15, serves to regulate the voltage that is delivered at the output pin 28 to an externally connected load 33. When, during normal operation, the voltage on the output falls below the regulated value, the voltage on the non-inverting input to the operational amplifier 20 falls below the value of the voltage applied to the inverting input terminal of the operational amplifier 20 as defined by the voltage of the bandgap generator 25. This turns on the PMOS transistor 13 and brings the output back up to the regulated value. In the case in which the voltage of the voltage supply 12 falls below a predetermined low value, the loop gain becomes lower than in the normal operation condition, since the PMOS transistor 13, or output device, goes into its linear region. The PMOS transistor 13 typically does not have enough Gn to supply the current load and still be able to maintain its output at the regulated voltage.

To address this problem, an additional circuit is provided in parallel with the power source 12 and the PMOS transistor 13. More particularly, a voltage divider that includes resistors 38 and 39 is connected in parallel with the power source 12 to provide a voltage on the interconnection node 40 that is proportionally related to the voltage provided by the power source 12. The interconnection node 40 between the voltage divider resistors 38 and 39 is connected to the non-inverting input terminal of a comparator 42. The inverting input terminal of the comparator 42 is connected to receive the output voltage provided by the bandgap generator 25. The output of the operational amplifier 42 is connected to the gate of a second P-channel MOS (PMOS) transistor 45, which is connected in parallel with the first PMOS transistor 13.

Thus, in operation, when the voltage that appears on the node 40 of the voltage divider resistors 38 and 39 falls below that defined by the reference potential of the bandgap voltage generator 25, the output from the operational amplifier 42 falls to zero. This turns on the PMOS transistor 45, thereby decreasing the electrical resistance between the voltage source 12 and the output terminal 28 to thereby provide a higher voltage on the output pin 28 for a longer period of time than if PMOS transistor 13 were to be used alone. Since the PMOS transistor 45 is normally nonconducting, it can be made relatively large to provide an extremely low resistance path when it is turned on, without affecting the stability of the voltage regulating feedback loop of the operational amplifier 20. Additionally, as shown, the operational amplifier 42 may include a predefined amount of hysteresis to avoid chatter in the operation of the circuit 10 when the voltage detected by the operational amplifier 42 is at or near the reference voltage provided by the bandgap generator 25.

It will be seen, therefore, that the PMOS transistor 45 serves essentially the function of the switch to connect the supply voltage from the supply 12 directly to the output terminal 28 when the voltage therefrom falls to the level defined by the bandgap generator 25. It will also be appreciated that during the time the PMOS transistor 45 is conducting when the circuit is in the low voltage mode, current is supplied directly to the load 33 outside of the regulating loop. This prolongs the time before the circuit is shutdown, in the case of a complete failure, or increases the output during a temporary low voltage condition, and enables necessary circuit and data protection measures to be taken as needed. Of course, during normal operation, the PMOS transistor 45 is turned off, and has no effect on the operation of the circuit 10.

With the circuit configured as above described, during normal operation, with $V_{BAT}$ within the range between $V_{MAX}$ and $V_{MIN}$, the loop circuit provided by the amplifier 20, the PMOS device 13, and the resistors 14 and 15 will be in regulation, the output voltage will be equal to:

$$V_{OUT}=\left(\frac{R_{14}+R_{15}}{R_{15}}\right)\times V_{Bandgap}\approx 5\text{ V}.$$

On the other hand, when the battery voltage $V_{BAT}$ decays down close to 6V, the PMOS transistor 13 will operate in the linear region. The loop gain will be decreased and $V_{OUT}$ will start to decay. Depending on the size of the PMOS transistor 13, $V_{OUT}$ could become too low and will not meet the circuit specification, especially under heavy load.

Through the use of the comparator 42 that senses the voltage supply $V_{BAT}$ from the voltage source 12, the second PMOS transistor 45 can be turned on. The second PMOS transistor 45 acts like a switch to pull $V_{OUT}$ close to $V_{BAT}$. Since at that moment, the $V_{BAT}$ voltage is closed to the specified $V_{OUT}$ value (about 0.5V above $V_{OUT}$), $V_{OUT}$ will be pulled up to $V_{BAT}$.

One application in which the circuit of the invention can be advantageously employed is in automotive applications in which, when the battery dies down, a lot of microprocessors need time to store all of the necessary information and protect different circuitry. By preventing the $V_{OUT}$=5V output voltage level from dying too quickly, especially with heavy load current $I_L$, the PMOS transistor 45 helps the PMOS transistor 13 to hold $V_{OUT}$ at a higher level longer. Therefore the microprocessor has more time to react and initiate necessary shut down measures.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A low voltage drop out circuit, comprising:

a voltage regulating transistor between a supply voltage and an output terminal;

an active feedback loop for controlling the voltage regulating transistor according to a magnitude of the supply voltage to control the voltage on the output terminal;

a reference voltage source to produce a reference voltage;

a switch in parallel with said voltage regulating transistor;

and a comparing circuit for determining when the supply voltage falls below the reference voltage to operate said switch.

2. The low voltage drop out circuit of claim 1 wherein said active feedback loop is configured to control the voltage regulating transistor to connect the supply voltage directly to the output terminal when the supply voltage falls below a predetermined value with respect to the reference voltage.

3. The low voltage drop out circuit of claim 1 wherein said active feedback loop comprises at least one sense resistor across which a sense voltage related to the output voltage is developed, and an operational amplifier having inputs for receiving the sense voltage and the reference voltage and an output to control the voltage regulating transistor.

4. The low voltage drop out circuit of claim 3 wherein said at least one sense resistor comprises a voltage divider comprising first and second sense resistors and wherein the sense voltage is derived between said first and second sense resistors.

5. The low voltage drop out circuit of claim 1 wherein said switch is a second transistor.

6. The low voltage drop out circuit of claim 5 wherein said second transistor is larger than said voltage regulating transistor.

7. The low voltage drop out circuit of claim 5 wherein said voltage regulating and second transistors are MOS transistors.

8. The low voltage drop out circuit of claim 1 wherein said reference voltage source is a band gap reference voltage source.

9. The low voltage drop out circuit of claim 1 wherein said comparing circuit comprises at least another sense resistor across which another sense voltage related to the supply voltage is developed, and a comparator having inputs for receiving the another sense voltage and the reference voltage and an output to control the switch.

10. The low voltage drop out circuit of claim 9 wherein said comparator has a predetermined hysteresis.

11. A low voltage drop out circuit, comprising:

a voltage regulating transistor between a supply voltage and an output terminal;

a reference voltage source to produce a reference voltage;

an operational amplifier for comparing the reference voltage to a voltage related to an output voltage on the output terminal, an output of the operational amplifier being connected to control the voltage regulating transistor according to a magnitude of the output voltage to control the voltage on the output terminal;

a switch in parallel with said voltage regulating transistor;

a comparator for comparing the reference voltage to a voltage related to the supply voltage, an output of the comparator being connected to control the switch according to a magnitude of the supply voltage to short across the voltage regulating transistor when the supply voltage falls below a predetermined level established by the reference voltage.

12. The low voltage drop out circuit of claim 11 wherein said operational amplifier is configured to control the voltage regulating transistor to connect the supply voltage directly to the output terminal when the output voltage falls below a predetermined value with respect to the reference voltage.

13. The low voltage drop out circuit of claim 11 wherein said voltage related to the output voltage is developed across at least one sense resistor.

14. The low voltage drop out circuit of claim 13 wherein said at least one sense resistor comprises a voltage divider comprising first and second sense resistors and wherein the sense voltage is derived between said first and second sense resistors.

15. The low voltage drop out circuit of claim 11 wherein said switch is a second transistor.

16. The low voltage drop out circuit of claim 15 wherein said voltage regulating and second transistors are MOS transistors.

17. The low voltage drop out circuit of claim 11 wherein said second transistor is larger than said voltage regulating transistor.

18. The low voltage drop out circuit of claim 11 wherein said reference voltage source is a band gap reference voltage source.

19. The low voltage drop out circuit of claim 11 wherein said voltage related to the supply voltage comprises at least another sense resistor across which another sense voltage related to the supply voltage is developed.

20. The low voltage drop out circuit of claim 11 wherein said comparator has a predetermined hysteresis.

21. A method for operating a low voltage drop out circuit of the type having a voltage regulating transistor between a supply voltage and an output terminal, a reference voltage source to produce a reference voltage, and an operational amplifier for comparing the reference voltage to a voltage related to an output voltage on the output terminal, an output of the operational amplifier being connected to control the voltage regulating transistor according to a magnitude of the output voltage to control the voltage on the output terminal, comprising the steps of:

comparing the reference voltage to a voltage related to the supply voltage to determine if the supply voltage has fallen below a predetermined level established by the reference voltage;

and when said supply voltage has fallen below the predetermined level, closing a switch in parallel with said voltage regulating transistor.

* * * * *